US006667608B2

(12) United States Patent
Wang

(10) Patent No.: US 6,667,608 B2
(45) Date of Patent: Dec. 23, 2003

(54) LOW VOLTAGE GENERATING CIRCUIT

(75) Inventor: Yen-Hui Wang, Hsinchu (TW)

(73) Assignee: King Billion Electronics Co., Ltd., Chupei (TW)

( * ) Notice: Subject to any disclaimer, the term of this patent is extended or adjusted under 35 U.S.C. 154(b) by 51 days.

(21) Appl. No.: 10/127,399

(22) Filed: Apr. 22, 2002

(65) Prior Publication Data

US 2003/0197496 A1 Oct. 23, 2003

(51) Int. Cl.[7] ..... G05F 3/16
(52) U.S. Cl. ..... 323/315
(58) Field of Search ..... 323/312, 313, 323/314, 315, 316, 901

(56) References Cited

U.S. PATENT DOCUMENTS 4,254,382 A * 3/1981 Keller et al. ..... 331/116 R
4,792,748 A * 12/1988 Thomas et al. ..... 323/312
6,118,262 A * 9/2000 Suzuki ..... 323/313
6,160,392 A * 12/2000 Shin ..... 323/313
6,201,378 B1 * 3/2001 Eto et al. ..... 323/313
6,285,245 B1 * 9/2001 Watanabe ..... 327/540

* cited by examiner

*Primary Examiner*—Adolf D. Berhane
(74) *Attorney, Agent, or Firm*—Hedman & Costigan, P.C.

(57) ABSTRACT

A low voltage generating circuit has a first current mirror to provide a first stable current, a second current mirror coupled to the first current mirror and a voltage generating unit connected to the second current mirror. The second current mirror provides a second current that is proportional to the first current in the voltage generating unit. The voltage generating unit utilizes three resistors in a T-shaped configuration, wherein a voltage output is taken from the T-shaped configuration and can output a voltage value less than one volt.

4 Claims, 5 Drawing Sheets

LOW VOLTAGE GENERATING CIRCUIT

BACKGROUND OF THE INVENTION

1. Field of Invention

The present invention relates to a low reference voltage generating circuit, and more particularly to a circuit that can provide a stable voltage lower than one volt.

2. Related Art

For the circuit design of portable products, besides the requirement of small size, an important consideration is the maximum reduction of the power consumed because the power supply for such portable products is a battery.

With reference to FIG. 5, a voltage generating circuit in accordance with the prior art comprises a current mirror (40), a voltage generating unit (45) and a start-up unit (50). The start-up unit (50) prevents FETs and transistors in the current mirror (40) and the voltage generating unit (45) to be biased at cutoff region. The current mirror (40) is made up of two P-channel FETs ($Q_1$, $Q_2$), two N-channel FETs ($Q_3$, $Q_4$), two PNP transistors ($Q_5$, $Q_6$) and a resistor ($R_1$). The voltage generating unit (45) has a P-channel FET ($Q_7$), a varistor ($VR_1$) and a PNP transistor ($Q_8$). The P-channel FET ($Q_7$) has a gate that is connected to the current mirror (40) and a source that is connected to the PNP transistor ($Q_8$) through the varistor ($VR_1$). An output terminal, denoted with $V_O$, is taken from the source of the P-channel FET ($Q_7$).

When each FET and each transistor is well biased, the current mirror (40) generates a first current ($I_1$) and a second current ($I_2$). By properly choosing the matched FETs and transistors in the current mirror (40), the second current ($I_2$) is approximately equal to the first current ($I_1$), and the voltage value at nodes X and Y (respectively denoted by $V_x$ and $V_y$) are also approximately the same. The first current ($I_1$) is represented:

$$I_1=(V_x-V_{BEQ5})/R_1$$
$$=(V_y-V_{BEQ5})/R_1$$
$$=(V_{BEQ6}-V_{BEQ5})/R_1$$

where $V_{BE}$ represents the junction voltage at the base-emitter junction of a transistor.

Further the junction voltage $V_{BE}$ can be represented as $V_{BE}=V_T\times\ln(k)$, where $V_T$ is the thermal voltage and is equal to approximately 25 mV at room temperature.

Thus, the first current ($I_1$) is rewritten as:

$$I_1=[V_T\times\ln(k_{Q6})-V_T\times\ln(k_{Q5})]/R_1$$
$$=[V_T\times\ln(k_{Q6}/k_{Q5})]/R_1$$
$$=[V_T\times\ln(n)]/R_1$$

where $n=k_{Q6}/k_{Q5}$ is the character ratio of the two PNP type transistors ($Q_5$ and $Q_6$)

Furthermore, an output current ($I_3$) flowing through the FET ($Q_7$) of the voltage generating unit (45) is approximately equal to the first current ($I_1$).

Thus the output voltage $V_O$ is $$V_O=I_3\times R_2+V_{BEQ8}.$$

When further combining the foregoing equation $I_1=[V_T\times\ln(n)]/R_1$ with $V_O=I_3\times R_2+V_{VBEQ8}$, the output voltage is obtained by the equation, $V_O=V_{BEQ8}+V_T\times\ln(n)\times(R_2/R_1)$.

The minimum value of the output voltage $V_O$ generated by the conventional circuit is still approximately 1.2 volts. In the field of high density integrated circuit design, the operating voltage of the elements in the integrated circuits is intended to be maintained as low as possible to reduce power consumption. Therefore, a constant voltage lower than 1.2 volts is necessary to be used with integrated circuits.

To overcome the shortcomings, a voltage generating circuit in accordance with the present invention obviates or mitigates the aforementioned problems.

SUMMARY OF THE INVENTION

The primary objective of the voltage generating circuit in accordance with the present invention is to provide a stable voltage lower than one volt to meet the need for a low operating voltage in integrated circuit design.

To achieve the objectives, the voltage generating circuit comprises a first current mirror, a second current mirror and a voltage generating unit. The first current mirror generates a first current. The second current mirror is connected to the first current mirror to generate a second current that is proportional to the first current. The voltage generating unit consists of three resistors in a T-shaped configuration. An output voltage node is taken from the T-shaped configuration to provide a voltage lower than 1 volt.

Other objects, advantages and novel-features of the invention will become more apparent from the following detailed description when taken in conjunction with the accompanying drawings.

DETAILED DESCRIPTION OF THE INVENTION

Figure 1:
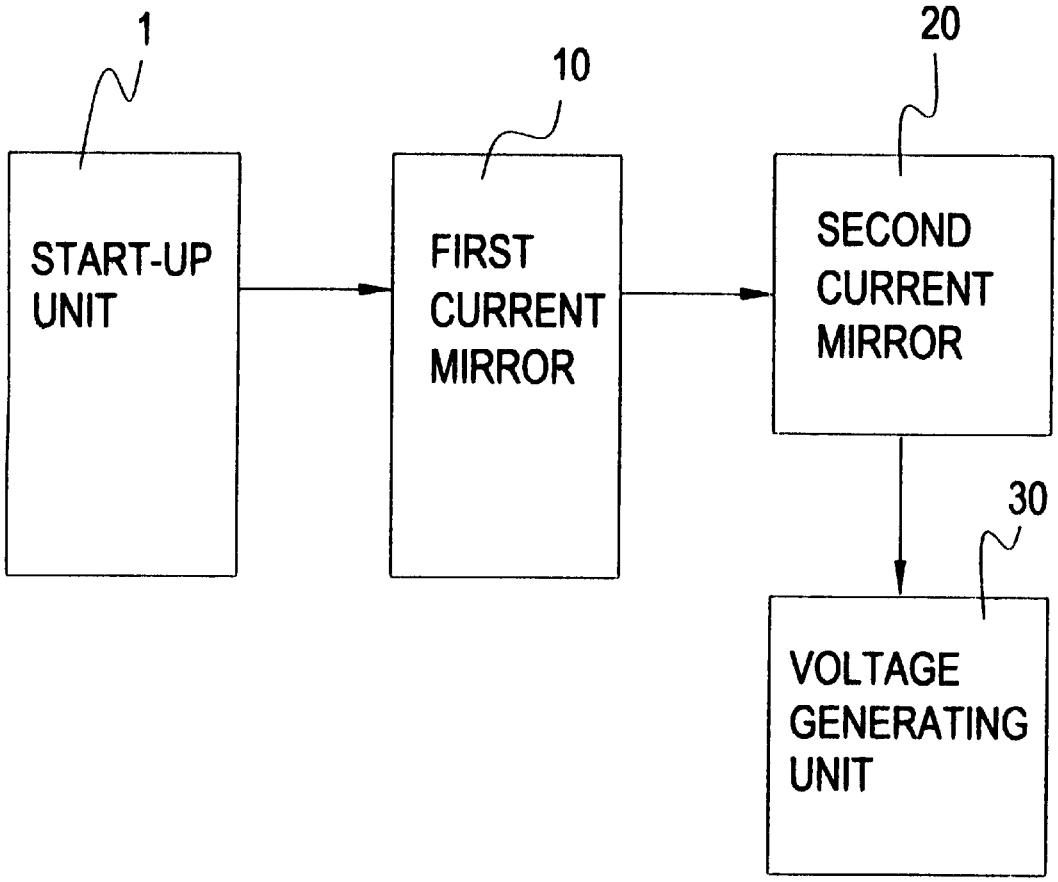
FIG. 1 is a block diagram of a low voltage generating circuit in accordance with the present invention.

With reference to FIG. 1, a low voltage generating circuit in accordance with the present invention comprises a first current mirror (10), a second current mirror (20) and a voltage generating unit (30). The biasing voltage for transistors or FETs in the first and second current mirror (10, 20) is initiated by a start-up unit (1). A voltage output node is taken from the voltage generating unit (30) and outputs a stable voltage less than 1 volt.

Figure 2:
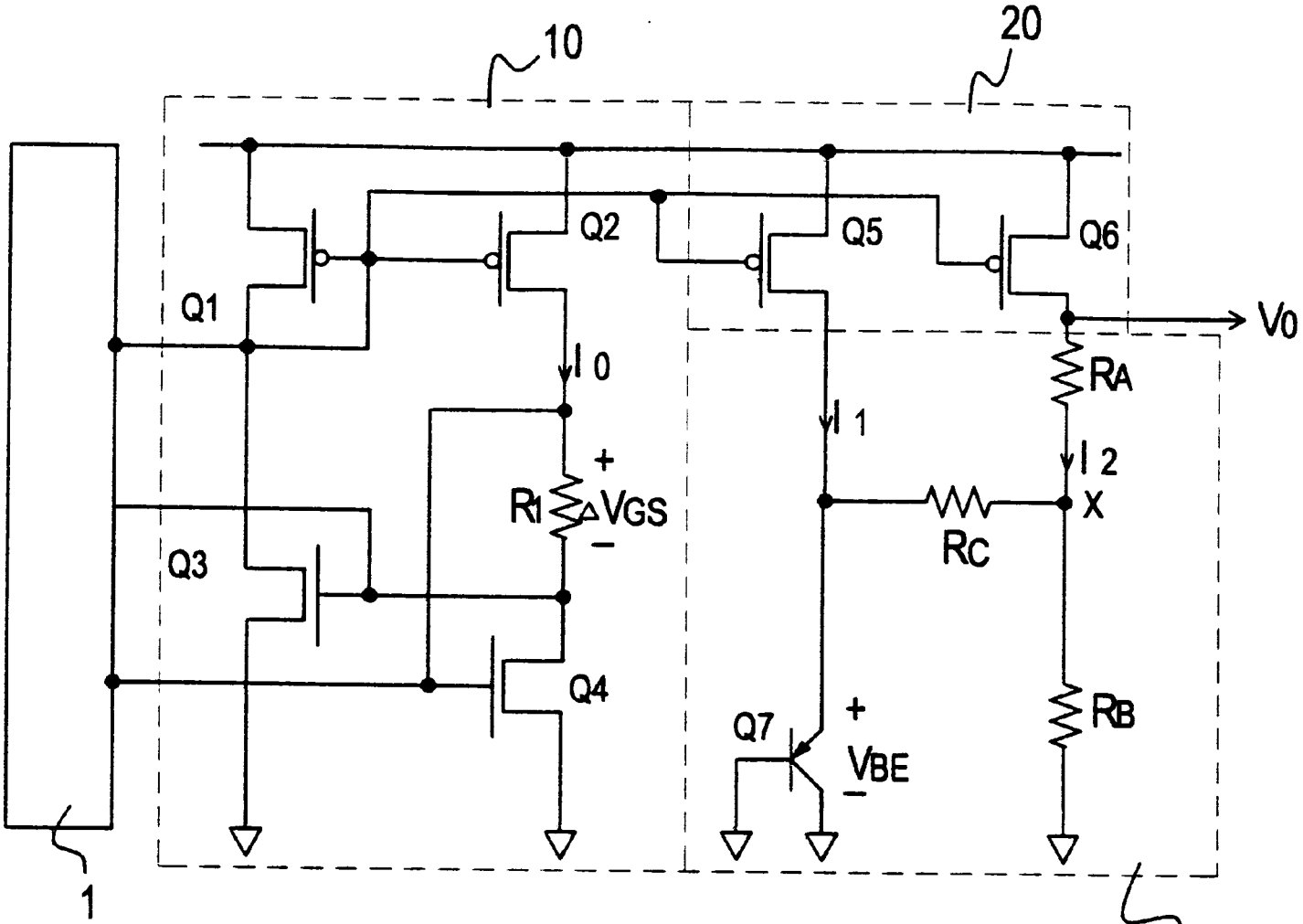
FIG. 2 is a circuit diagram of a first embodiment of the low voltage generating circuit in accordance with the present invention.

With reference to FIG. 2, the first current mirror (10) in a first embodiment of the low voltage generating circuit consists of two p-channel FETs ($Q_1$, $Q_2$), two n-channel FETs ($Q_3$, $Q_4$) and a resistor ($R_1$). The second current mirror (20) comprises a first p-channel FET ($Q_5$) and a second p-channel FET ($Q_6$) with their gates connected to the first current mirror (10).

The voltage generating unit (30) comprises a PNP transistor ($Q_7$) and three resistors ($R_A$, $R_B$ and $R_C$) in a T-shaped configuration. The first resistor ($R_A$) is connected to the second resistor ($R_B$) in series at node "X," and both are connected between ground and the source of the second p-channel FET ($Q_6$). The source of the first p-channel FET ($Q_5$) is connected to the emitter of the PNP transistor ($Q_7$). The third resistor ($R_C$) is connected between the node "X" and the emitter of the PNP transistor (Q7). A voltage output is taken from the source of the second p-channel FET (Q6).

By properly choosing the FETs and determining a bias voltage for the FETs, a second current ($I_1$) through the FET ($Q_5$) and a third current ($I_2$) through the FET ($Q_6$) can be respectively proportion to a first current ($I_0$)through the FET ($Q_2$). For example, $2I_2=I_1=2I_0$. In this embodiment, the current proportion is $I_2=I_0$. The two p-channel FETs ($Q_1$, $Q_2$) are operated in saturation, and the two n-channel FETs ($Q_3$, $Q_4$) are operated in weak inversion. The ratio of channel length to channel width of the two n-channel FETs ($Q_3$, $Q_4$) are respectively represented with $W_{Q3}/L_{Q3}$ and $W_{Q4}/L_{Q4}$. A parameter "n" is further defined by the two ratios, where $$\frac{W_{Q3}}{L_{Q3}} \Big/ \frac{W_{Q4}}{L_{Q4}} \equiv n.$$

The voltage value across the resistor ($R_1$) is represented by $$\Delta V_{GS}=V_T\cdot\ln(n)$$

where $V_T$=kT/q is the thermal voltage. Thereby the current $I_0=I_2$ can be calculated by the following equation.

$$I_0=\Delta V_{GS}/R_1=[V_T\cdot\ln(n)]/R_1$$

By applying Kirchhoff's voltage law (KVL) at the node X, a first equation is obtained:

$$\frac{V_X - V_{BE}}{R_C} + \frac{V_X}{R_B} + \frac{V_X - V_O}{R_A} = 0 \tag{1}$$

Furthermore, the voltage $V_x$ at node "X" can be represented as:

$$V_X=V_O-I_2\times R_A \tag{2}$$

To rewrite and rearrange the first equation (1), a third equation is obtained:

$$V_X\left(\frac{1}{R_A}+\frac{1}{R_B}+\frac{1}{R_C}\right)=\frac{V_{BE}}{R_C}+\frac{V_O}{R_A} \tag{3}$$

By substituting the second equation (2) into the third equation (3), the output voltage Vo is obtained by equations as follows.

$$\Rightarrow V_O\left(\frac{1}{R_A}+\frac{1}{R_B}+\frac{1}{R_C}-\frac{1}{R_A}\right)=\frac{V_{BE}}{R_C}+I_2\cdot R_A\left(\frac{1}{R_A}+\frac{1}{R_B}+\frac{1}{R_C}\right)$$

$$\Rightarrow V_O\cdot\left(\frac{R_B+R_C}{R_B\cdot R_C}\right)=\frac{V_{BE}}{R_C}+\frac{[V_T\cdot\ln(n)]}{RI}\cdot R_A\left(\frac{1}{R_A}+\frac{1}{R_B}+\frac{1}{R_C}\right)$$

$$\Rightarrow V_O\cdot\left(\frac{R_B+R_C}{R_B\cdot R_C}\right)=V_{BE}\cdot\frac{R_B}{R_B+R_C}+V_T\cdot\ln(n)\cdot\frac{R_AR_B+R_BR_C+R_CR_A}{R_1(R_B+R_C)}$$

-continued $$\Rightarrow V_O\frac{R_B}{R_B+R_C}\left(V_{BE}+V_T\cdot\ln(n)\cdot\frac{R_A+R_C+\frac{R_CR_A}{R_B}}{R_1}\right)$$

Note that since the coefficient $R_B/(R_B+R_C)$ is smaller than 1, the output voltage Vo is proved to be less than one volt.

Figure 3:
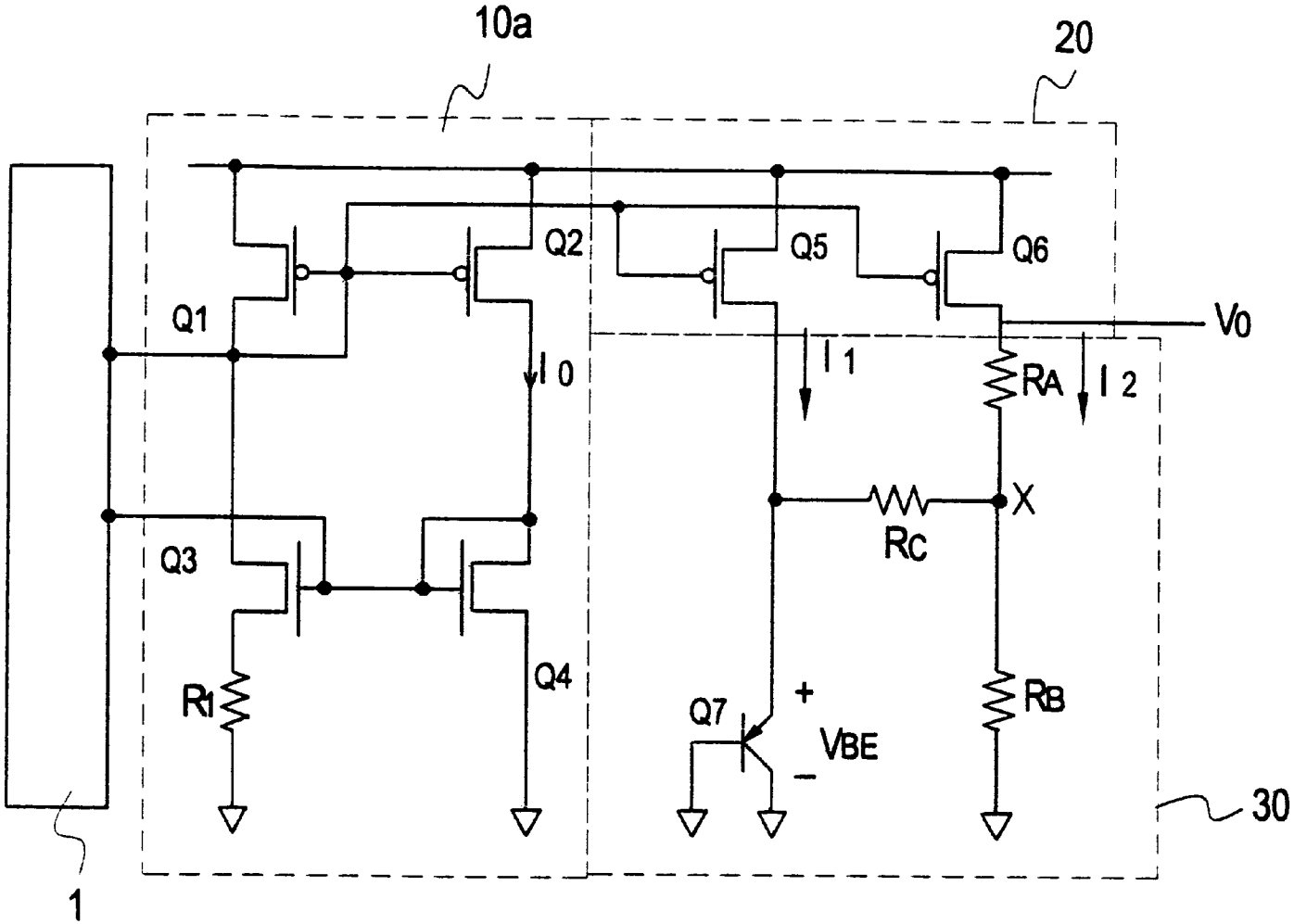
FIG. 3 is a circuit diagram of a second embodiment of the low voltage generating circuit in accordance with the present invention.

With reference to FIG. 3, the second embodiment of the present invention is substantially the same as the first embodiment. The difference between the two embodiments is that the first current mirror (10*a*) is replaced by another configuration, i.e. the connection of resistor ($R_1$) is changed. The first current mirror (10*a*) still provides a stable current ($I_0$), and the current ($I_1$) and ($I_2$) are proportional to the current ($I_0$). The output voltage ($V_O$) is still less than 1 volt.

Figure 4:
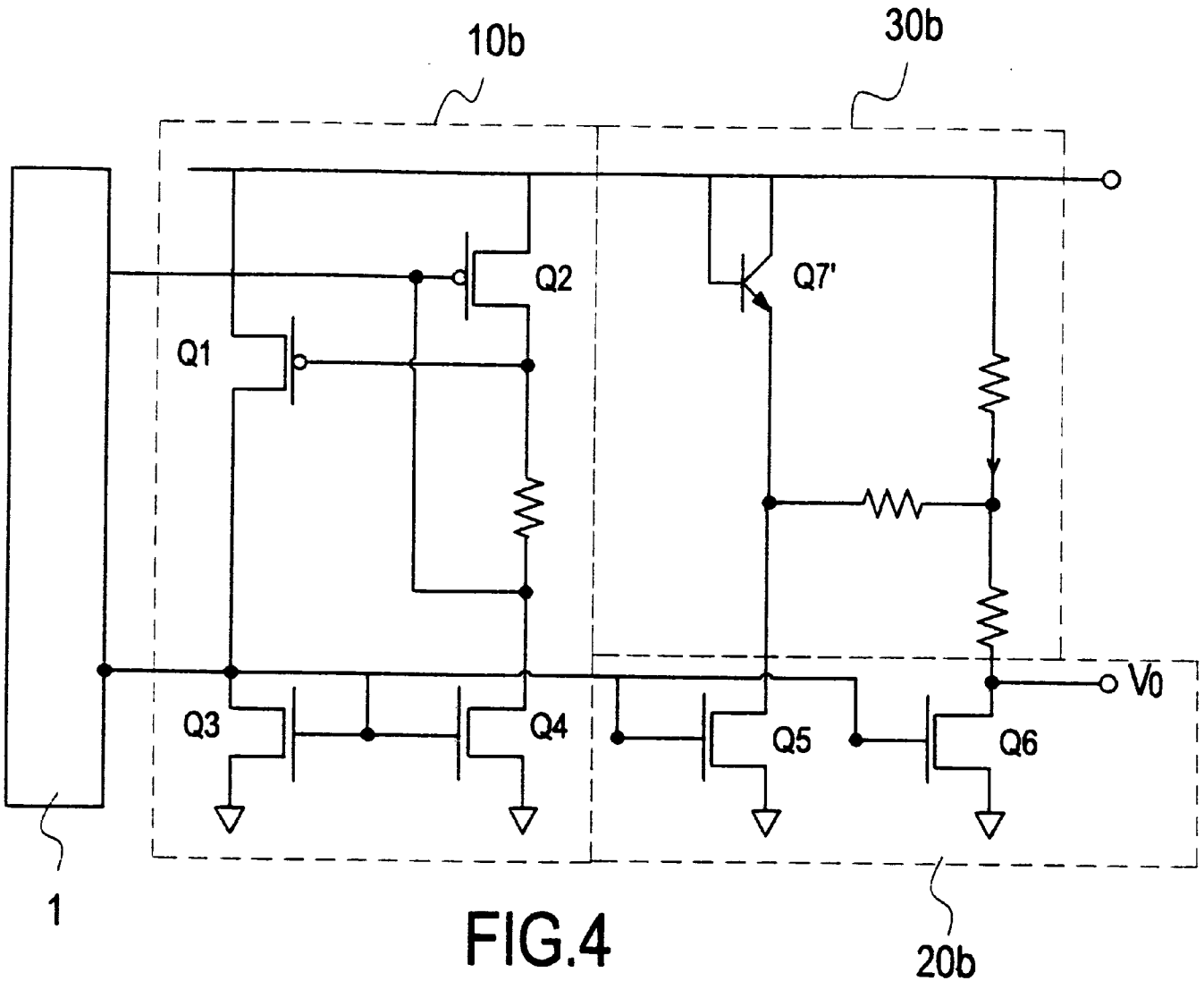
FIG. 4 is a circuit diagram of a third embodiment of the low voltage generating circuit in accordance with the present invention.
Figure 5:
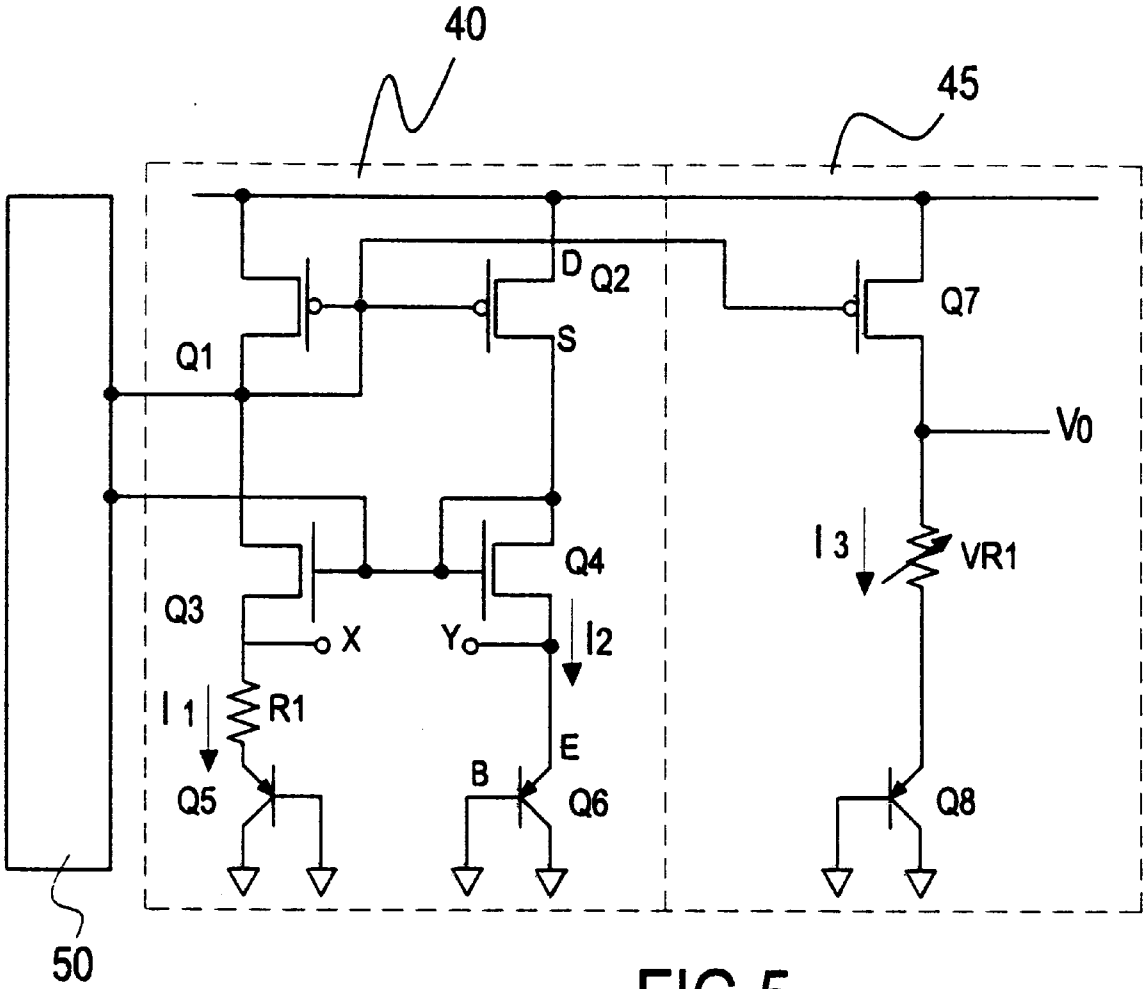
FIG.5 PRIOR ART
FIG. 5 is a circuit diagram of a conventional voltage generating circuit.

With reference to FIG. 4, the third embodiment utilizes two n-channel FETs ($Q_5$, $Q_6$) as the second current mirror (20*b*). The original PNP transistor ($Q_7$) in the first embodiment of the voltage generating unit (30) is replaced by a NPN transistor ($Q_7$'). The voltage generating unit (30*b*) still has three resistors in a T-shaped configuration. The output voltage is taken from the source of the n-channel FET ($Q_6$)

From the foregoing description of the embodiments, a low voltage generated by the circuit in accordance with the invention is proved to be lower than 1 volt. When the voltage generating circuit is employed to the integrated circuits design, the power consumed can be reduced.

What is claimed is:

1. A voltage generating circuit comprising:

a first current mirror to generate a first current;

a second current mirror coupled to the first current mirror and generating a second current that is proportion to the first current; and a voltage generating unit comprising three resistors in a T-shaped configuration and connected to the second current mirror, wherein a voltage output is taken from the voltage generating unit to output a voltage value less than one volt.

2. The voltage generating circuit as claimed in claim 1, wherein the second current mirror comprises at least a first transistor and a second transistor.

3. The voltage generating circuit as claimed in claim 2, wherein the voltage generating unit comprises:

a first resistor connected between the second transistor and a second resistor in series, wherein a connecting node of the first resistor and the second resistor is a first node, and the second resistor is further connected to ground;

a third transistor connected between the first transistor of the second current mirror and ground, wherein a connecting node of the first transistor and the third transistor is a second node; and a third resistor connected between the first node and the second node;

wherein the voltage output is taken from a connecting node of the second transistor and the first resistor.

4. The voltage generating circuit as claimed in claim 3, wherein the third transistor is a PNP transistor with a base, an emitter and a collector, wherein the base and the collector are connected to ground and the emitter is connected to the first transistor of the second current mirror.

* * * * *